United States Patent [19]

Fox

[11] Patent Number: 5,043,627

[45] Date of Patent: Aug. 27, 1991

[54] HIGH-FREQUENCY FLUORESCENT LAMP

[76] Inventor: Leslie Z. Fox, 2712 Colby Ave., West Los Angeles, Calif. 90064

[21] Appl. No.: 579,945

[22] Filed: Sep. 10, 1990

Related U.S. Application Data

[63] Continuation of Ser. No. 222,707, Mar. 1, 1988, abandoned.

[51] Int. Cl.[5] ..... H01J 61/67; H01J 61/30

[52] U.S. Cl. ..... 313/491; 313/631; 313/493; 313/643; 315/246

[58] Field of Search ..... 313/491, 574, 621, 631, 313/632, 493, 90, 643; 315/246, DIG. 5

[56] References Cited

U.S. PATENT DOCUMENTS

| | | | |
|---|---|---|---|
| 1,932,025 | 10/1933 | Thomas | 313/627 |
| 2,216,269 | 10/1940 | Holmes | 332/39 |
| 2,449,113 | 9/1948 | Fruth | 313/631 X |
| 2,709,767 | 5/1955 | Germer | 313/623 |
| 3,189,777 | 6/1965 | Hoeh | 313/492 |
| 3,430,090 | 2/1969 | Vodoklys et al. | 313/486 |
| 3,444,415 | 5/1969 | Skirvia | 313/491 |
| 3,536,945 | 10/1970 | Skirvin | 313/491 X |
| 4,122,374 | 10/1978 | Studli | 315/DIG. 5 |
| 4,272,703 | 6/1981 | Eckberg | 313/491 |
| 4,347,460 | 8/1982 | Latassa et al. | 313/493 X |

FOREIGN PATENT DOCUMENTS

| | | | |
|---|---|---|---|
| 0121750 | 7/1984 | Japan | 313/491 |

*Primary Examiner*—Sandra L. O'Shea
*Assistant Examiner*—Michael Horabik
*Attorney, Agent, or Firm*—Albert O. Cota

[57] ABSTRACT

A high-frequency fluorescent lamp (10) that is energized by an electronic high-frequency ballast (50). The two ends of the lamp are hermetically sealed by a set of base assemblies (14). Each assembly consists of an end cap (16) and a non-thermionic, high-frequency radiating element (18) that includes an integral input power pin (20). The radiating elements function as cathode/antennas that operate within a pressurized noble gas environment without the need for mercury. Since there is no mercury to vaporize nor any thermionic emission, the lamps, upon the application of power, start immediately to emit a high-frequency signal. This signal directly bombards and excites the lamps phosphor coating which causes the phosphor to fluoresce and emit visible light.

6 Claims, 2 Drawing Sheets

1/2

2/2
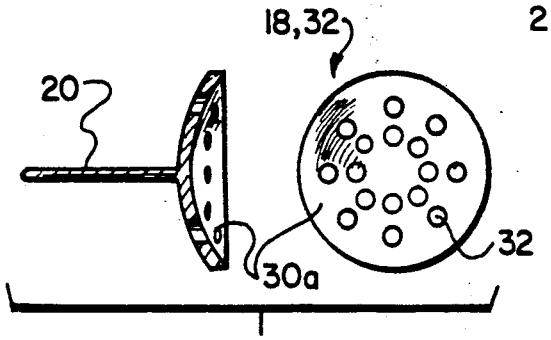
Fig.6.
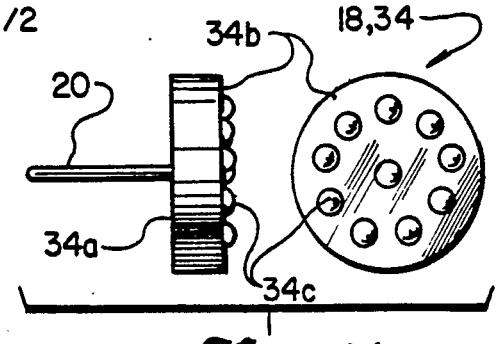
Fig.7.
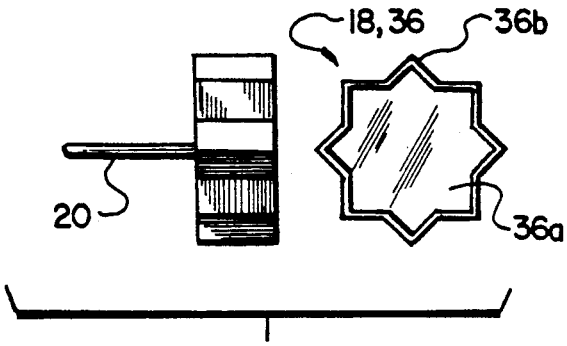
Fig.8.
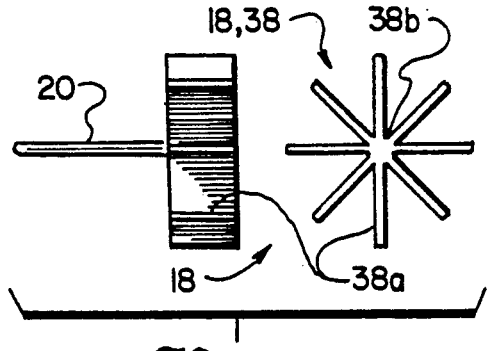
Fig.9.
Fig.10.
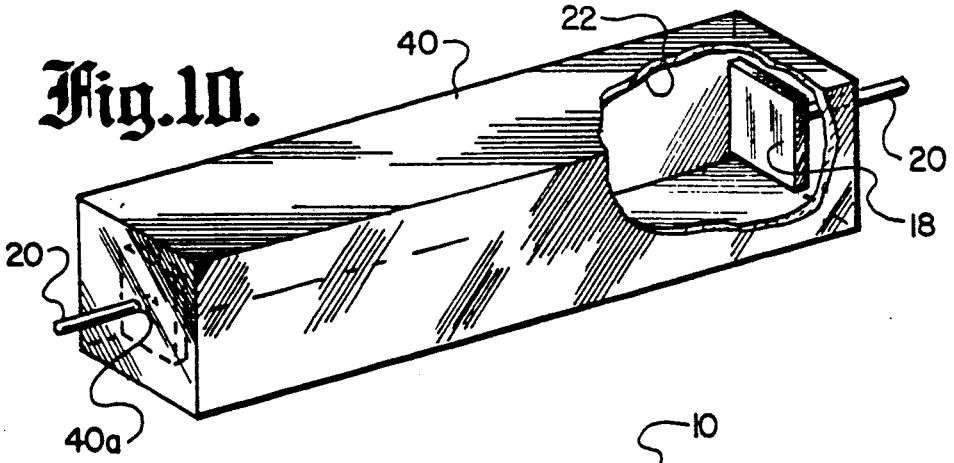
Fig.11.
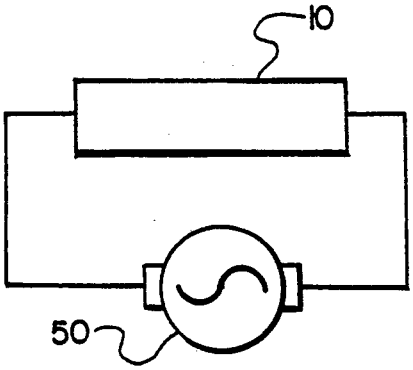

HIGH-FREQUENCY FLUORESCENT LAMP

CROSS REFERENCE TO RELATED APPLICATION

This application is a continuation of application Ser. No. 07/222,707 filed 03/01/88, now abandoned.

TECHNICAL FIELD

The invention pertains to the general field of electric discharge lamps such as fluorescent lamps and more particularly to a fluorescent lamp that incorporates a set of non-thermionic radiating elements that function as cathodes/antennas in a ionized gas environment to radiate a high-frequency electron stream that directly excites the lamps phosphor coating to produce a visible light.

BACKGROUND ART

Most fluorescent lamps in use today are electric discharge lamps, that are usually in the form of a long glass tube coated internally with one or more fluorescent powders, commonly called phosphors. Electrodes are located at each end of the tube that are made with iron, nickel or tungsten, and which are commonly coated with an electron-emissive material. The tube is evacuated and filled at a certain pressure with a noble gas, which is usually argon, neon, krypton or xenon. In addition, there is also inserted in the tube a small drop of mercury which vaporizes during operation of the tube.

In the operation of a fluorescent lamp, an electrical discharge passing from the electrode at one end of the tube to the electrode at the other end, through the noble gas and the mercury vapor, generates ultraviolet radiation. The radiation, in turn, excites the phosphor coating on the wall of the tube to emit visible light.

The phosphors in general use have the characteristic that, when they are excited by ultraviolet radiation of about 253.7 millimicrons wavelength, they will emit visible light. In current designs, the mercury vapor performs the function of converting the energy in an electron discharge into electromagnetic photons of the proper wavelength for exciting the tube phosphor.

The basic lighting mechanism of fluorescent lamp performance is that free electrons emitted from the more negative electrode in the tube collide with the valence electrons of the luminescent gas—in the prior art, mercury vapor. The collision of the discharge electrons with the valence electrons excites the latter by imparting to them part of the kinetic energy of the former, thus raising the valence electrons out of their normal energy level to a level of higher energy. When such an excited electron returns to its equilibrium valence band, part of the excess energy is discarded as surplus, once it returns to its low energy state, is emitted as a lower energy photon.

The predominant measure of efficiency of fluorescent lamp performance is a parameter called "efficacy", which is the ratio of luminous flux output (lumens) to total power input (watts). The highest efficacy theoretically attainable is 680 lumens per watt, which is the output that would be obtained if all the input power were converted to green light at a 555 millimicrons wavelength, the light wavelength to which the human eye is most sensitive. The maximum theoretical efficacy of any light source producing white light with its entire output distributed uniformly with respect to wavelength within the visible region is only 200 lumens per watt. Thus, it can be seen that by concentrating the output wavelength of any light source near the 555 millimicron point, efficacy can be improved beyond that possible with white light. The efficacy of present-day fluorescent lamps is about 55 to 65 lumens per watt.

One of the predominant problems and sources of expense and weight in present-day fluorescent lamps is the necessity for a starting circuit. A fluorescent lamp has a negative resistance characteristics; that is the resistance across the lamp decreases once current begins to flow through the gas in the tube. Moreover, in order to initiate current flow, a much higher voltage must be imposed across the tube than can be used once the tube is operating normally. Thus, present fluorescent lamps must be started by an especially high voltage generated by capacitor storage or some other transient method. Once they have started, they have to operate with some sort of current controls, such as a ballast.

In the course of starting a fluorescent lamp, a high voltage ranging up to 1000 volts may be used to force electron emission from the electrodes into the tube. This type of electron flow will be maintained until the gases in the tube are ionized to sustain the flow with lower voltage. It is the violence of such starting methods on the electrodes and end fittings of the tubes that limits the useful service life of the lamps. In particular, the oxide coating on the electrodes "sputters" during starting, causing the characteristic blackening at the end of the tube and reducing the amount of electron-emissive material on the electrode that is needed to perform the function of providing electron flow in the tube. Not only does the sputtering cut down on the service life of the lamps; it is also the major factor in the lumen maintenance ability of the tube. That is, the capability of the tube to maintain the same output of lumens per watt input throughout its life that it had at some reference time after its service began.

Another disadvantage in present fluorescent lamps is the narrow ambient temperature range in which the lamp can operate. A mercury vapor fluorescent lamp reaches its maximum efficiacy at 77° F., above that point the efficacy falls off about 10 percent for each 20° F. increase, due to the increasing ionization of the mercury vapor molecules, thus precluding ionization due to electron bombardment. As ambient temperature declines from 77° F., the fall-off in efficiency is even more extreme because the mercury droplets present in the tube will not vaporize at all.

Other disadvantages associated with present-day mercury vapor fluorescent lamps include:

- the high end losses and inefficiency of the presently used electrodes,
- the RFI problem created by the ionization of mercury and its resulting electromagnetic radiation and RFI power line coupling, both of which are capable of creating a buzz in radios that are located in the vicinity of the fluorescent lamp. Although the radiation of RFI can be suppressed somewhat by the use of heavy shielding, the conduction of RFI noise signals back from the electrodes of the fluorescent tube can be prevented only by the use of noise decoupling filters, either in connection with the tube or in connection with the radio sets nearby, and,
- since mercury is a known poison and an untold quantity of defective lamps are destroyed and dumped in waste areas. The mercury ends-up as pollution that can poison our water tables.

A search of the prior art did not disclose any patents that read directly on the claims of the instant invention however, the following U.S. Pat. Nos. were considered related:

| U.S. PAT. NO. | INVENTOR | ISSUED |
|---|---|---|
| 59-121750 (Japan) | Shinto et al | 13 July 1984 |
| 4,272,703 | Eckberg | 15 June 1979 |
| 3,536,945 | Skirvin | 27 October 1970 |
| 3,189,777 | Hoeh | 15 June 1965 |
| 2,961,565 | Lemmers | 22 November 1960 |

The Shinto patent discloses a cold negative ion electric discharge lamp. The lamp consists of a light permeable outer container which has electric discharge electrodes on both ends and contains mercury and a gaseous body for providing an electric discharge boost. The discharge electrodes consists of a composite metal of lanthanum and nickel or its pulverulent body.

The Eckberg patent discloses a lamp that includes a group of columns positioned within the lamp envelope. Each column has an electron emissive cathode mounted therein connected to a cathode lead-wire. An anode member connected to an anode lead-wire extends to the upper portions of each column. A conductive starter member is mounted within each column to provide a gap between one of its ends and the cathode. A second gap is located between the other of its ends and the associated anode extension. The anode and cathode are energized by a d-c voltage.

The Skirvin patent discloses a luminescent gas tube which includes a mixture of selected gases that operate at resonance which results in a lower power consumption and an enhancement in the luminescence of the tube. There is also disclosed a new type of electrode that has a ball shape with an electron-emission section composed of boroncarbide. The ball electrode produces a high electron emission rate for a given unit of power.

The Hoeh patent discloses a fluorescent lamp that keeps the sputtering of the electrode and the resultant end blackening of the lamp to a minimum. This result is achieved by fabricating the electrodes from a martenistic type stainless steel which is more sputter-resistant than conventional types made from nickel or ferritic stainless steel.

The Lemmers patent discloses a low-pressure discharge lamp wherein the ratio of perimeter to area of the cross section (p/a) is substantially greater than in circular-sectioned lamps of the same perimeter.

By increasing the p/a ratio there is either an improved efficiency at a given wattage per unit length of lamp, or higher wattage loading per unit length for the same efficiency. The ratio increase is achieved by flattening a round tube to an oval or loop-like cross section.

DISCLOSURE OF THE INVENTION

The high-frequency fluorescent lamp is designed to operate with a set of simplified electrodes, hereinafter referred to as a high-frequency radiating elements, within a non-mercury ionized gas environment. When the elements are energized by an electronic high-frequency generator, it emits a stream of high-frequency electrons that directly bombard and excite the lamps phosphor coating to produce visible light.

The inventive lamp eliminates the major problems inherent in currently available fluorescent lamps by having a design that eliminates the conventional two-power level ballast, the need for mercury, and for thermionic emission electrodes. Because there is no mercury used, the attendant problems caused by the mercury, as described in the BACKGROUND ART, are eliminated.

The simplified construction and structural elements employed in the invention lend themselves to allowing lamps of various geometries and sized to be easily manufactured with an increase in lumen efficiency. The radiating elements can also be configured and selected in the most efficient shape that best suits the envelope configuration of the lamp.

By using the radiating elements, in lieu of conventional thermionic electrodes, the useful operating life of the lamp is greatly increased. The life of conventional fluorescent lamps is governed by the rate loss of the electrons emitted by the electrodes. When these electrons are emitted, the emissive coating on the electrode is eroded. Erosion is especially high during the lamps initial start-up when a high current is required. Since the inventive lamp uses no such filament electrodes there is considerably less erosion to reduce the lamps useful operating life. Additionally, studies in vacuum tubes has shown that by increasing the electron emitting area of the cathode, the tube life can be increased from 1000 hours to up to 50,000 hours. Although, this areas increase is impractical in current electrode designs, it is easily accomplished in the instant design.

In operation, the radiating elements function as cathode/antennas where the emitted high-frequency electrons are transported by the ionized gas to the lamps phosphor coating. Since no heat, or at worse very little heat, is generated during this electron transfer phase, the lamps remain cool and are not affected by the outside ambient temperatures, whether those temperatures be hot or cold. Conventional lamps are especially difficult to start during cold weather.

In view of the above disclosures, it is the primary object of the invention to provide a new fluorescent lamp that increases the efficacy and efficiency of the lamp in terms of more light per input power. This increase is achieved by a lamp design that employs a set of cold running, high-frequency radiating elements that operate, within a single or combination gas environment to produce light when the electrons emitted by the radiating element strike and excite the phosphor in the tube.

It is also an object of the invention to produce a lamp that:

- maintains a constant lumen output over an extended useful operating life,
- does not require high start-up currents,
- operates over a wide range of ambient temperatures,
- is less costly to manufacture due to the elimination of the mercury and the simplified construction of the radiating elements, and
- can be manufactured in a variety of geometric shapes.

These and other objects and advantages of the present invention will become apparent from the subsequent detailed description of the preferred and second embodiment and the claims taken in conjuction with the accompanying drawings.

BRIEF DESCRIPTION OF THE DRAWINGS

FIG. 6 is a perspective view of a radiating element comprised of a frontal concave structure that has a plurality of bores therethrough.

FIG. 7 is a perspective view of a radiating element comprised of a disk-like structure having a front radiating surface with a plurality of convex bumps.

FIG. 8 is a perspective view of a radiating element comprised of an element comprised of a disk-like structure having a star configuration with a plurality of stars.

FIG. 9 is a perspective view of a radiating element comprised of a plurality of plates where the inward side of each plate terminates at the center about the power input pin.

FIG. 10 is a perspective view of the second embodiment of the high-frequency fluorescent lamp which include a cutaway view showing the placement of the radiating elements.

FIG. 11 is a schematic shown the lamp connected to an electronic high-frequency ballast.

BEST MODE FOR CARRYING OUT THE INVENTION

Figure 1:
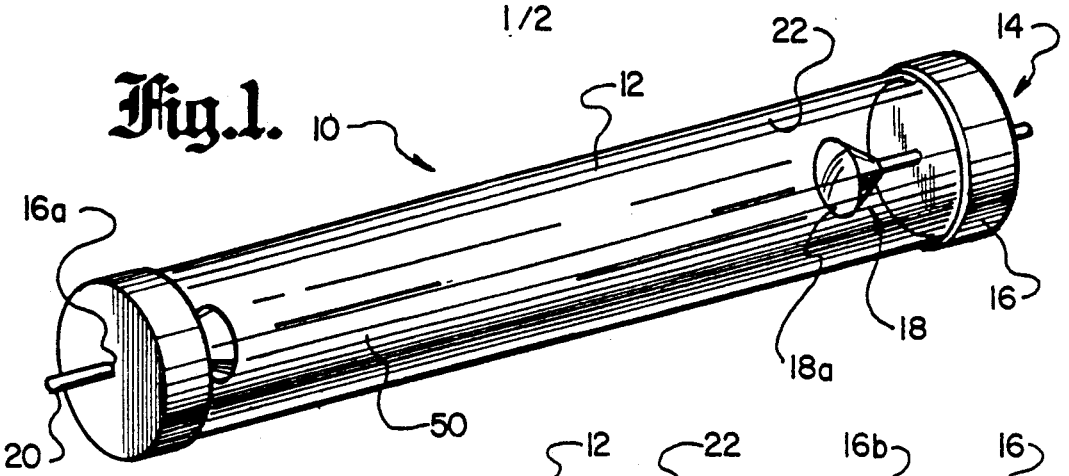
FIG. 1 is a perspective view of the preferred embodiment of the high-frequency fluorescent lamp which includes a partial cutaway view of the base assembly with the end cap and radiating element.

The best mode for carrying out the invention is presented in terms of a preferred embodiment and a second embodiment. Both embodiments of the high-frequency fluorescent lamp 10 are designed to be energized by an electronic high-frequency generator 60 with an output between 10 KHz and 50 KHz. The inside surface of the lamp 10 is coated with a rare-earth phosphor that is directly excited by electrons emitted by a cold operating high-frequency radiating element that is energized by the high-frequency generator. Additionally, the instant lamp 10 does not require hot filaments or mercury to operate. Therefore, it runs cool, is not affected by extreme ambient temperatures and has a much greater useful life than conventional fluorescent lamps.

The preferred embodiment, as shown in FIGS. 1 through 9 is comprised of the following five major elements: a clear hollow tube 12, a base assembly 14 consisting of an end cap 16, and a conductive high-frequency radiating element 18 having a front radiating surface 18*a* with a power input pin 20 extending from the back.

The first embodiment, as shown in FIG. 1, employs a clear hollow tube 12 that is round and constructed of glass. Although glass is preferred, a clear plastic such as an acrylic may also be used to construct the tube. The inside surface of the tube 12 is conventionally coated with a fluorescent powder 22 such as a rare-earth phosphor. The phosphor may also be blended with other elements to produce a "warmer" light output when the fluorescent powder is excited.

Hermetically attached to each end of the tube 12 is the base assembly 14 that consists of the end cap 16, the conductive high-frequency radiating element 18 and the power input pin 20. The end cap 16 is configured and sized to fit on the end of the tube 12 and includes a pin bore 16*a* that extends through the center of the cap. Since there are two tube openings two base assemblies are required.

The conductive high-frequency radiating element 18 is constructed with a front radiating surface 18*a*, a back surface 18*b* and an integral power pin 20 that extends from the elements back surface.

The radiating element has a radiating surface diameter that is selected so that there is approximately a 1 mm gap between the diameter of the radiating surface and the inside diameter of the tube 12.

In the design of the lamp 10, it was found that the 1 mm gap provides sufficient room for manufacturing tolerances and sufficient radiating surface to allow the radiating element to provide optimum radiation.

The power input pin 20 has a diameter that allows the pin to slide into the pin bore 16*a* and to extend outwardly from the outside surface of the end cap 16. In the preferred design only one pin is shown or required. However, the radiating element 18 can also be configured with two power pins in parallel. The dual pin configuration (not shown) allows the lamp to be inserted into the two-pin sockets which are currently in use. Thus, by changing the conventional ballast with an electronic high-frequency generator, the instant lamps, with the two-pins, can be directly used with the existing fluorescent light fixtures.

Figure 2:
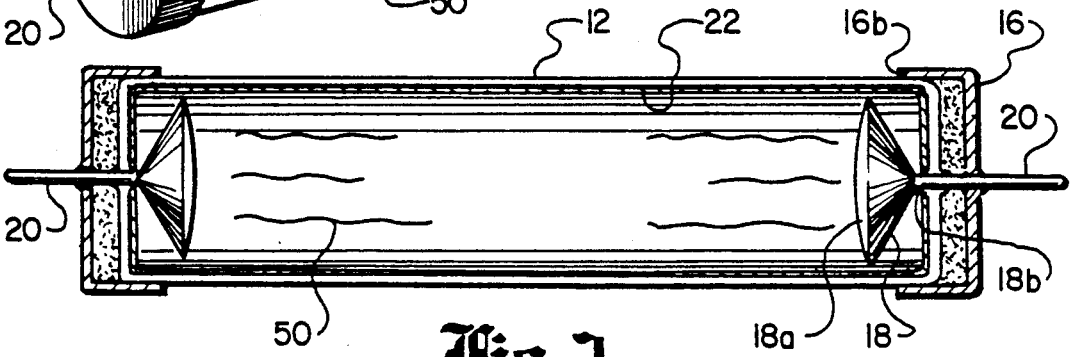
FIG. 2 is a partial cutaway side view of one end of the tube showing the end cap and radiating element.

After the interfacing area between the pin and pin bore is hermetically sealed the entire base assembly 14 is hermetically attached to the end of the tube 12 as best shown in FIG. 2. Likewise, an identical assembly is attached to the other end of the tube. In the preferred embodiment, the end cap 16 is made with an outwardly extending circumferential lip 16*b* that allows the cap to fit over the outside surface of the tube 12 to add additional structural integrity. Before the end caps are attached, the tube 14 is evacuated and filled with an optimum quantity of pressurized ionizable noble gas 50. The gas normally used is argon. However, other noble gases such as neon, krypton or xenon are also employed. A mixture of these ionizable gases may also be used to achieve different color outputs and lumen intensities. The method and equipment used to evacuate and fill the tube with the gases is well known in the art and is therefore not described.

Figure 3:
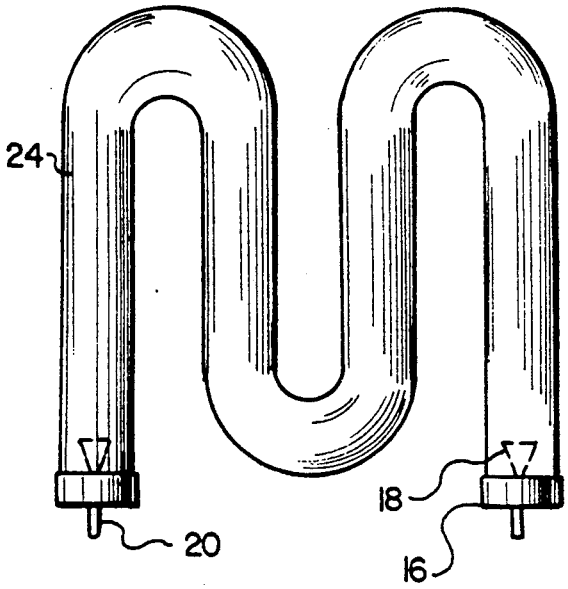
FIG. 3 is a side view of one envelope configuration that may be used with the preferred embodiment.

The configuration of the tube 12 is not limited to a straight tube. As shown in FIG. 3, the tube may be manufactured of a contiguous multi-curved section 24. Although a triple-bend tube is shown, various configuration may be employed with equal results.

Figure 4:
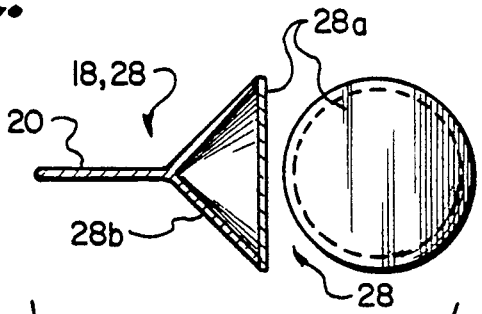
FIG. 4 is a perspective view of a radiating element comprised of front flat radiating surface and a back conic section.

As shown in FIGS. 4–9, the conductive high-frequency radiating element 18 may be configured in the following shapes:

FIG. 4 discloses an element 28 comprised of a structure having a front flat radiating surface 28*a* and a back conic section 28*b*.

Figure 5:
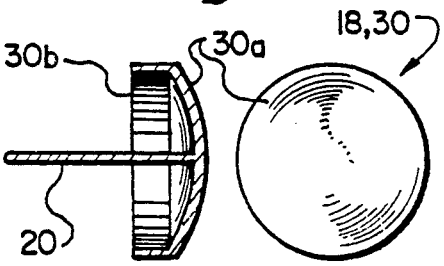
FIG. 5 is a perspective view of a radiating element comprised of a disk-like structure having a front convex radiating surface and a flat back section.

FIG. 5 discloses an element 30 comprised of a disk-like structure having a front convex radiating surface 30*a* and a flat back section 30*b*.

FIG. 6 disclose an element 32 comprised of a frontal concave structure 32*a* that has a plurality of bores 32*b* therethrough.

FIG. 7 discloses an element 34 comprised of a disk-like structure 34*a* having a front radiating surface 34*b* with a plurality of convex bumps 34*c*.

FIG. 8 discloses an element 36 comprised of a disk-like structure 36*a* having a star configuration with a plurality of stars 36*b*.

FIG. 9 discloses an element 38 comprised of a plurality of plates 38*a* where the inward side 38*b* of each plate terminates at the center about the power input pin 20.

In all of the above designs, the radiating element is constructed of a conductive (non-insulating) material. Although a metal, such as copper or steel is preferred, a conductive ceramic or plastic material may also be used.

The second embodiment, as shown in FIG. 10, employs a rectangular clear hollow structure 40 that has its inside wall surface coated with a fluorescent powder 22 as described in the preferred embodiment. On one of the inside walls is attached, by an adhesive, a conductive high-frequency radiating element 18 and on the opposite wall of the structure 40 is attached a similar second element 18. The structure has a pin bore 40*a* centered on each of the element attaching walls that allows the power input pin 20 extending from the back of the elements 18 to be hermetically fitted so that the pin extends outwardly from the wall.

As with the first embodiment, the inside of the structure is evacuated and filled with an optimum quantity of pressurized ionizable gas.

Both embodiments of the high-frequency lamp 10 are operated by connecting the two single power pins 20 to an electronic high-frequency generator 60 as shown in FIG. 11. Since in the instant design there is no requirements for a thermionic emission or mercury vaporization, the lamps will start immediately upon the application of the high-frequency signal.

When operating, the radiating elements 18 function as cathode/antennas operating within the ionizable noble gas environment. When the high-frequency electrons travelling through the gas strike and excite the phosphor, the phosphor fluoresces and emits a visible light.

While the invention has been described in complete detail and pictorially shown in the accompanying drawings, it is not to be limited to such details, since many changes and modifications may be made in the invention without departing from the spirit and the scope thereof. For example, the invention can also be used to replace many of the so called High Intensity Discharge (HID) lamps. The HID lamps include lamps that use mercury vapor, metal halide and low and high pressure sodium. All of these lamps use mercury to produce the UV electrons that excite the lamps phosphor to produce light. The HID lamps, as well as other types of fluorescent lamps, such as circle line lamps, come equipped with a variety of power input pin configurations. Regardless of the pin quantity or size, the instant invention can be manufactured with an identical configuration to allow replacement. Hence, the invention is described to cover any and all modifications and forms which may come within the language and scope of the claims.

I claim:

1. A high-frequency fluorescent lamp comprising:

a) a clear hollow tube having its inside surface coated with a fluorescing material, b) an end cap configured and sized to fit on the end of said tube with said cap having a pin bore therethrough, c) a conductive high-frequency radiating element having a front radiating surface and an integral power input pin extending from the back surface of said radiating element where said pin is sized to hermetically fit into the pin bore in said end cap where said pin extends outwardly from the outside surface of said end cap, and where a base assembly, consisting of said end cap and radiating element, is heremetically attached to each end of said tube, d) means for evacuating and hermetically encapsulating within said tube an optimum quantity of pressurized ionizable gas that is free of the element mercury, and e) means to ionize said gas and cause a high-frequency electron emission from said radiating element to strike and excite said fluorescent material to cause said lamp to fluoresce and emit visible light.

2. The high-frequency fluorescent lamp as specified in claim 1 where said fluorescent material is comprised of a phosphor that can be blended with other elements to produce a "warmer" light output.

3. The high-frequency fluorescent lamp as specified in claim 1 wherein said means to ionize said gas is accomplished by applying across said power input pin a high frequency signal.

4. A high-frequency fluorescent lamp comprising:

a) a clear hollow structure having its inside wall surface coated with a fluorescing material, b) a conductive high-frequency radiating element attached to each inside end of said structure with each of said elements having an input power pin extending from its back surface where the pin is hermetically fitted into and extends outwards from a pin bore located on the respective end of said structure, c) means for evacuating and hermetically encapsulating within said structure an optimum quantity of pressurized ionizable gas that is free of the element mercury, and d) means to ionize said gas and cause a high-frequency electron emission from said radiating element to strike and excite said fluorescent material to cause said lamp to fluoresce and emit visible light.

5. The high-frequency fluorescent lamp as specified in claim 4 where said fluorescent material is comprised of a phosphor that can be blended with other elements to produce a "warmer" light output.

6. The high-frequency fluorescent lamp as specified in claim 4 wherein said means to ionize said gas is accomplished by applying across said power input pin a high frequency signal.

* * * * *